US008649716B2

(12) United States Patent
Yoshioka

(10) Patent No.: US 8,649,716 B2
(45) Date of Patent: Feb. 11, 2014

(54) IMAGE FORMING APPARATUS

(75) Inventor: Tomoaki Yoshioka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 329 days.

(21) Appl. No.: 12/855,346

(22) Filed: Aug. 12, 2010

(65) Prior Publication Data

US 2011/0194877 A1 Aug. 11, 2011

(30) Foreign Application Priority Data

Feb. 8, 2010 (JP) ..... 2010-025885

(51) Int. Cl.
*G03G 15/01* (2006.01)

(52) U.S. Cl.
USPC ..... 399/299; 399/297; 399/300; 399/302; 399/306; 399/308; 399/318

(58) Field of Classification Search
USPC ..... 399/297, 299, 300, 302, 306, 308, 318
See application file for complete search history.

(56) References Cited

U.S. PATENT DOCUMENTS

| | | | | |
|---|---|---|---|---|
| 6,922,542 | B2 * | 7/2005 | Mizuno et al. | 399/302 |
| 6,934,497 | B2 * | 8/2005 | Hagiwara et al. | 399/302 |
| 2005/0185991 | A1 * | 8/2005 | Iwakura et al. | 399/299 |

FOREIGN PATENT DOCUMENTS

JP A-2005-91613 4/2005

* cited by examiner

*Primary Examiner* — Ryan Walsh
(74) *Attorney, Agent, or Firm* — Oliff PLC

(57) ABSTRACT

An image forming apparatus includes toner image forming units that are arranged in a line at two end portions and at an intermediate portion of the line, each of the toner image forming units forming a toner image; an image transfer body to which the toner images formed by the toner image forming units are transferred; pressing members that are linearly arranged so that each of the pressing members faces a corresponding one of the toner image forming units with the image transfer body therebetween, each of the pressing members applying a pressing force to the image transfer body; and a fixing unit that fixes the toner images on a recording member. The pressing forces applied by the pressing members that are disposed at the two end portions are smaller than the pressing force applied by the pressing member that is disposed in the intermediate portion.

7 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2010-025885 filed Feb. 8, 2010.

BACKGROUND (i) Technical Field

The present invention relates to an image forming apparatus.

(ii) Related Art

An image forming apparatus using an electrophotographic method, such as a copier or a printer, uniformly charges a photoconductor having, for example, a drum-like shape, exposes the photoconductor to light that is controlled on the basis of image information, and thereby forms an electrostatic latent image on the photoconductor. The image forming apparatus converts the electrostatic latent image to a visible image of toner (toner image), transfers the toner image to a recording sheet, fixes the toner image using a fixing unit, and thereby forms an image.

SUMMARY

According to an aspect of the invention, there is provided an image forming apparatus comprising a plurality of toner image forming units each forming a toner image; an image transfer body to which the toner images formed by the plurality of toner image forming units are transferred; a plurality of pressing members that are arranged so that each of the plurality of pressing members faces a corresponding one of the toner image forming units with the image transfer body therebetween, each of the plurality of pressing members applying a pressing force to the image transfer body; and a fixing unit that fixes the toner images on a recording member, wherein a pressing member disposed at each of two end portions of a line of pressing members is located at a different position, than a pressing member that is disposed in an intermediate portion of the line of pressing members, along a pressing direction of the plurality of pressing members.

BRIEF DESCRIPTION OF THE DRAWINGS

Exemplary embodiment of the present invention will be described in detail based on the following figures, wherein.

DETAILED DESCRIPTION

Hereinafter, an exemplary embodiment of the present invention will be described with reference to the drawings.

Description of Image Forming Apparatus

Figure 1:
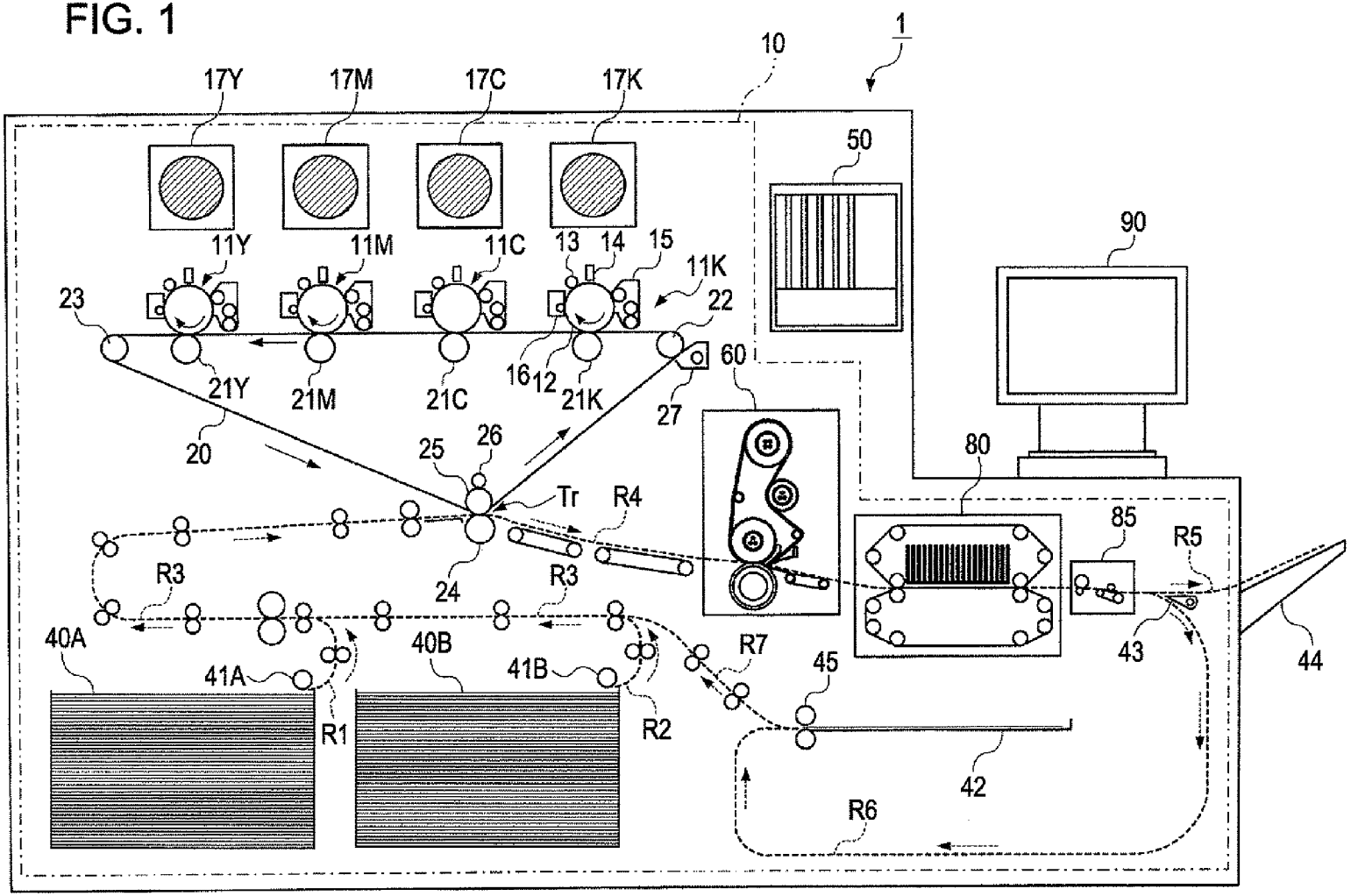
FIG. 1 illustrates the structure of an image forming apparatus according to the exemplary embodiment.

FIG. 1 illustrates the structure of an image forming apparatus 1 according to the exemplary embodiment. The image forming apparatus 1 illustrated in FIG. 1 is a so-called "tandem-type" color printer. The image forming apparatus 1 includes an image forming section 10, a controller 50, and a user interface (UI) section 90. The image forming section 10 forms an image on the basis of image data. The controller 50 performs, among others, controlling of the overall operation of the image forming apparatus 1, communication with a personal computer (PC) or the like, and image processing on the image data. The UI section 90 receives input from a user and displays various information to the user.

Description of Image Forming Section

The image forming section 10 is a functional section that forms an image by using, for example, an electrophotographic method. The image forming section 10 includes four image forming units 11Y, 11M, 11C, and 11K that are parallely disposed (hereinafter collectively referred to as "image forming units 11"). The image forming units 11 are examples of a toner image forming unit. Each of the image forming units 11 includes functional components, such as a photoconductor drum 12, a charger 13, an exposure section 14, a developing section 15, and a cleaner 16. The photoconductor drum 12, which is an example of a photoconductor, forms a toner image by developing an electrostatic latent image formed with toner on a surface thereof. The charger 13 charges the surface of the photoconductor drum 12 to a predetermined voltage. The exposure section 14 exposes the photoconductor drum 12, which is charged by the charger 13, on the basis of image data. The developing section 15 develops the electrostatic latent image, which has been formed on the photoconductor drum 12, using toner of different colors. The cleaner 16 cleans the surface of the photoconductor drum 12 after the transfer.

The developing sections 15 of the image forming units 11 are respectively connected to toner containers 17Y, 17M, 17C, and 17K (hereinafter collectively referred to as "toner containers 17") containing toner of different colors through toner transfer paths (not shown). Supply screws (not shown), which are disposed in the toner transfer paths, supply the toner of different colors from the toner containers 17 to the developing sections 15.

Except for the color of the toner contained in the developing sections 15, the image forming units 11 have the same structure and are arranged in a line. The image forming units 11 respectively form toner images of yellow (Y), magenta (M), cyan (C), and black (K).

The image forming section 10 includes an intermediate transfer belt 20 and first transfer rollers 21Y, 21M, 210, and 21K (hereinafter collectively referred to as "first transfer rollers 21"). The color toner images formed on the photoconductor drums 12 of the image forming units 11 are transferred to the intermediate transfer belt 20, which is a example of an image transfer body. The first transfer rollers 21, which is an example of a pressing member, transfer (first transfer) the color toner images formed by the image forming units 11 to the intermediate transfer belt 20.

The intermediate transfer belt 20 is made of a resin, rubber material, or the like including an appropriate amount of carbon black as a conductive agent. Examples of the resin include polyimide, polycarbonate, polyester, polypropylene, polyethylene terephthalate, acrylic, and vinyl chloride. The intermediate transfer belt 20 has a volume resistivity in the range of, for example, $10^6$ Ω·cm to $10^{15}$ Ω·cm and a thickness in the range of, for example, 0.06 mm to 0.1 mm.

The first transfer rollers 21 are provided so as to correspond to the image forming units 11Y, 11M, 11C, and 11K. Therefore, in the exemplary embodiment, there are four first transfer rollers 21Y, 21M, 21C, and 21K. In the exemplary embodiment, the first transfer rollers 21 are linearly arranged so as to face the image forming units 11 with the intermediate transfer belt 20 therebetween, and applies a pressing force to the intermediate transfer belt 20. Toner images of different colors are transferred to the intermediate transfer belt 20 with the pressing force and a first transfer bias, which will be described below in detail.

The image forming section 10 further includes a driving roller 22, a span roller 23, a second transfer roller 24, a backup roller 25, a power feed roller 26, and a fixing unit 60. The driving roller 22 is connected to a driving source, such as a motor (not shown), for rotating the intermediate transfer belt 20. The intermediate transfer belt 20 is looped over the span roller 23. The second transfer roller 24 simultaneously transfers (second transfers) the color toner images, which have been transferred to the intermediate transfer belt 20 in an overlapping manner, to a sheet that is a recording member (recording sheet). The backup roller 25 is disposed so as to face the second transfer roller 24 and nip the sheet therebetween. The power feed roller 26 supplies a second transfer bias used for performing second transfer, which will be described below in detail. The fixing unit 60, which is an example of a fixing device, fixes the color toner images, which have been second transferred, on the sheet.

The image forming section 10 further includes a cooling unit 80 and a curl correction unit 85. The cooling unit 80 cools the color toner images, which have been fixed on the sheet by the fixing unit 60, so as to facilitate fixing of the color toner images on the sheet. The curl correction unit 85 corrects a curl of the sheet.

In the image forming apparatus 1 according to the exemplary embodiment, the intermediate transfer belt 20, the first transfer roller 21, and the second transfer rollers 24 constitute a transfer unit. Hereinafter, a region in which the second transfer roller 24 is disposed and in which the color toner images are second transferred from the intermediate transfer belt 20 will be referred to as a "second transfer region Tr".

Description of Sheet Transport System

The image forming section 10 further includes, as a sheet transport system, plural sheet containers (in the exemplary embodiment, two sheet containers 40A and 40B), feed rollers 41A and 41B, a first transport path R1, and a second transport path R2. The sheet containers 40A and 40B contain sheets. The feed rollers 41A and 41B feed the sheets contained in the sheet containers 40A and 40B and transport the sheet. The first transport path R1 transports the sheets from the sheet container 40A. The second transport path R2 transports the sheets from the sheet container 40B. The image forming section 10 further includes a third transport path R3 that transports the sheets from the sheet containers 40A and 40B toward the second transfer region Tr. The image forming section 10 further includes a fourth transport path R4 and a fifth transport path R5. The fourth transport path R4 transports the sheet, to which the color toner images have been transferred in the second transfer region Tr, through the fixing unit 60, the cooling unit 80, and the curl correction unit 85. The fifth transport path R5 transports the sheet from the curl correction unit 85 toward a sheet tray 44 that is disposed in a discharge section of the image forming apparatus 1.

Transport rollers and transfer belts are disposed along the first to fifth transport paths R1 to R5 so as to successively transport the sheets that are fed thereto.

Description of Double-Sided Transport System

The image forming section 10 includes, as a double-sided transport system, an intermediate sheet container 42, a sixth transport path R6, and a seventh transport path R7. The intermediate sheet container 42 temporarily holds the sheet having a first surface on which the color toner images have been fixed by the fixing unit 60. The sixth transport path R6 transports the sheet from the curl correction unit 85 toward the intermediate sheet container 42. The seventh transport path R7 transports the sheet held in the intermediate sheet container 42 toward the third transport path R3. The image forming section 10 further includes a distribution mechanism 43 and a feed roller 45. The distribution mechanism 43, which is disposed downstream of the curl correction unit 85 in the sheet transport direction, selectively distributes the sheets to the fifth transport path R5 extending to the sheet tray 44 and to the sixth transport path R6 extending to the intermediate sheet container 42. The feed roller 45 feeds a sheet held in the intermediate sheet container 42 and transports the sheet toward the seventh transport path R7.

Description of Image Forming Operation

Fundamental image forming operation performed by the image forming apparatus 1 according to the exemplary embodiment will be described.

The image forming units 11 of the image forming section 10 respectively form the color toner images in Y color, M color, C color, and K color by using the electrophotographic process using the functional members described above. The first transfer roller 21 successively first transfers the color toner images formed by the image forming units 11 to the intermediate transfer belt 20, so that the color toner images are superposed to form a composite toner image. The intermediate transfer belt 20 rotates in the direction indicated by an arrow, so that the composite toner image formed on the intermediate transfer belt 20 is transported to the second transfer region Tr, in which the second transfer roller 24 is disposed.

In the sheet transport system, the feed rollers 41A and 41B rotate in time with the image formation performed by the image forming units 11 so as to feed a sheet selected by, for example, the UI section 90 from among the sheets contained in the sheet container 40A and the sheet container 408. The sheet fed by the feed roller 41A or 418 is transported along the first or second transport path R1 or R2 and the third transport path R3, and reaches the second transfer region Tr.

In the second transfer region Tr, the composite toner image held on the intermediate transfer belt 20 is second transferred to the sheet with a transfer electric field formed by the second transfer roller 24.

The sheet, to which the composite toner image has been transferred, is separated from the intermediate transfer belt 20 and transferred to the fixing unit 60 along the fourth transport path R4. The fixing unit 60 fixes the composite toner image on the sheet transported to the fixing unit 60 so as to form a fixed image. The cooling unit 80 cools the sheet, on which the fixed image has bee formed, and the curl correction unit 85 corrects a curl of the sheet. When performing one-sided printing, the distribution mechanism 43 guides the sheet, which has passed through the curl correction unit 85, to the fifth transport path R5 to be transported to the sheet tray 44.

The cleaner 16 and a belt cleaner 27 respectively remove toner remaining on the photoconductor drum 12 after the first transfer has been finished (first-transfer residual toner) and toner remaining on the intermediate transfer belt 20 after the second transfer has been finished (second-transfer residual toner).

When performing double-sided printing, the distribution mechanism 43 guides the sheet, on which the fixed image has been formed on the first surface thereof and which has passed through the curl correction unit 85, to the sixth transport path R6 to be transported to the intermediate sheet container 42. Again, the feed roller 45 rotates in time with the image formation on the second surface performed by the image forming units 11 so as to feed the sheet from the intermediate sheet container 42. The sheet, which has been fed by the feed roller 45, is transported along the seventh transport path R7 and the third transport path R3 to the second transfer region Tr.

In the second transfer region Tr, as with the first surface, the color toner images held on the intermediate transfer belt 20 are simultaneously transferred to the second surface of the sheet with transfer electric field formed by the second transfer roller 24.

As with the first surface, the fixing unit 60 fixes the toner images, which have been transferred to the first and second surfaces of the sheet, the cooling unit 80 cools the sheet, and the curl correction unit 85 corrects the curl of the sheet. The distribution mechanism 43 guides the sheet, which has passed through the curl correction unit 85, to the fifth transport path R5 to be transported to the sheet tray 44.

In this way, the image forming apparatus 1 repeatedly performs the image formation process for the number of prints.

Description of First Transfer System

Figure 2:
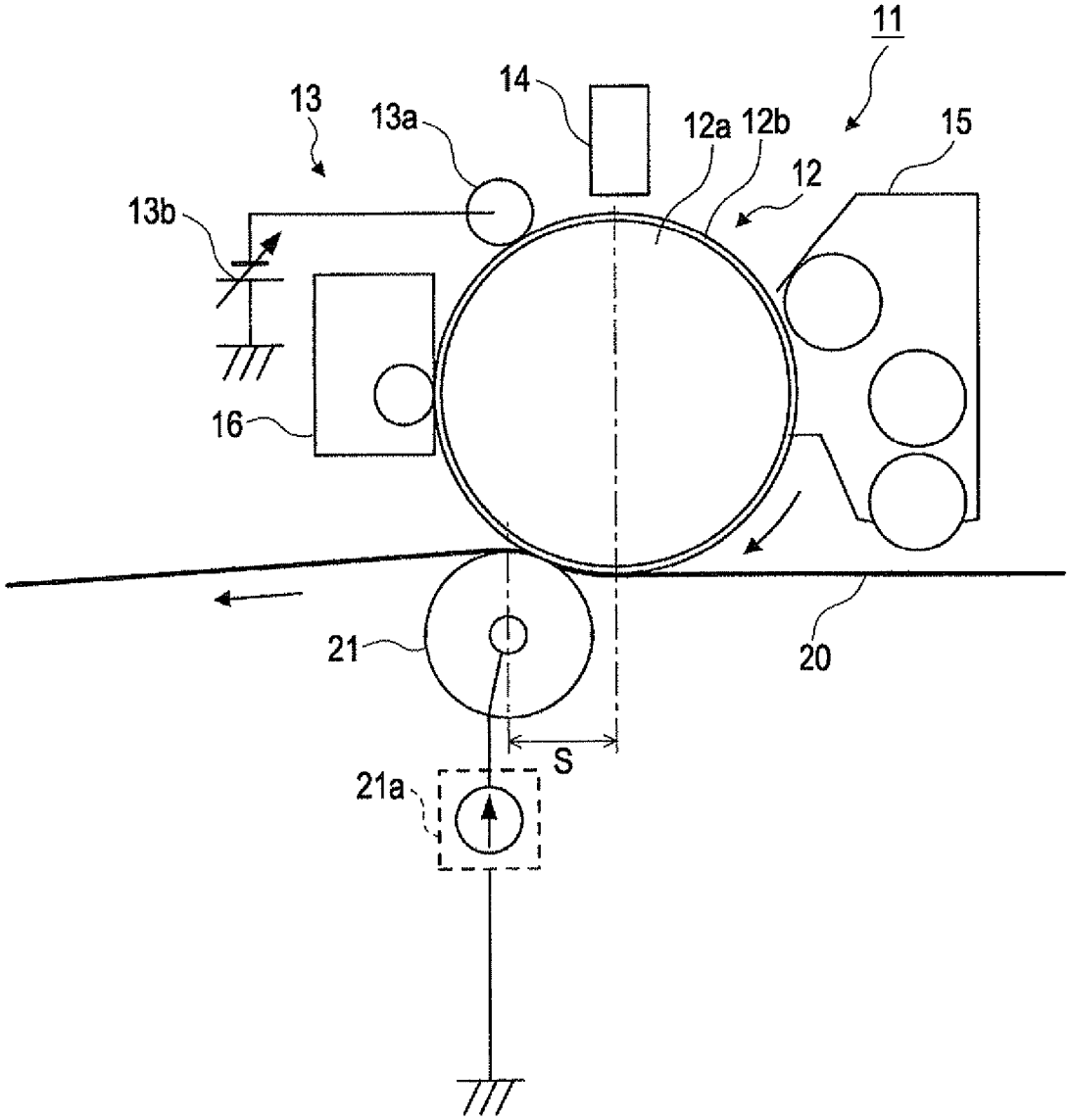
FIG. 2 illustrates in detail a first transfer system of the image forming apparatus according to the exemplary embodiment.

FIG. 2 illustrates in detail a first transfer system of the image forming apparatus according to the exemplary embodiment.

The photoconductor drum 12 includes a base member 12*a*, which is made of, for example, an aluminum cylinder, and an organic photosensitive layer 12*b* formed on the outer peripheral surface of the base member 12*a*. The charger 13 includes a charging roller 13*a* and a charging power source 13*b*. The charging roller 13*a* is disposed so as to be pressed against the photoconductor drum 12 and rotated by the photoconductor drum 12. The charging power source 13*b* applies a predetermined amount of charging bias (a negative bias in the exemplary embodiment) to the charging roller 13*a*.

The first transfer roller 21 includes a conductive core made of, for example, stainless steel and a cover made of a conductive elastic foam of rubber. The resistance of the first transfer roller 21 is adjusted by adding a material having ion conductivity (for example, NBR rubber (nitrile rubber)) to the conductive elastic foam. In the initial state, the first transfer roller 21 may have a volume resistivity of, for example, in the range of $10^5$ to $10^9$ Ω·cm and a hardness (Asker C hardness) in the range of 30° to 50°. The resistance of the first transfer roller 21 may be adjusted by adding a material having electron conductivity (for example, carbon black) instead of a material having ion conductivity. The diameter of the first transfer roller 21 is, for example, 28 mm.

The first transfer roller 21 is connected to a current source 21*a* whose output current value is adjustable, and the base member 12*a* of the photoconductor drum 12 is grounded. Under a predetermined control, the current source 21*a* applies a positive transfer bias (first transfer current) to the first transfer roller 21. The current source 21*a* applies the first transfer bias to the photoconductor drum 12 through the first transfer roller 21 and the intermediate transfer belt 20, so that a transfer electric field is generated between the photoconductor drum 12 and the intermediate transfer belt 20, whereby the toner images are transferred from the photoconductor drum 12 to the intermediate transfer belt 20.

In the exemplary embodiment, the axis of the first transfer roller 21 is not disposed directly below the axis of the photoconductor drum 12, and is disposed at a position displaced therefrom in the direction in which the intermediate transfer belt 20 moves. That is, the axes are disposed at offset positions. In FIG. 2, the distance between the axes is represented by the distance S between the alternate-long-and-short-dash lines, which are center lines of the first transfer roller 21 and the photoconductor drum 12. The photoconductor drum 12 and the first transfer roller 21 are disposed so as to overlap each other when viewed from above. By disposing the photoconductor drum 12 and the first transfer roller 21 so as to be at offset positions and so as to overlap each other when viewed from above, the length (wrap amount) over which the intermediate transfer belt 20 contacts the photoconductor drum 12 is increased. Thus, the toner images are more securely first transferred.

In the exemplary embodiment, the toner images are transferred to the sheet in the second transfer region Tr. There are another type of image forming apparatuses that do not have the second transfer region Tr and in which the first transfer system transfers the toner images to the sheet. The technique according to the exemplary embodiment may be used to adjust the transfer condition of such type of image forming apparatuses.

Description of Second Transfer Region Tr (Secondary Transfer System)

Figure 3:
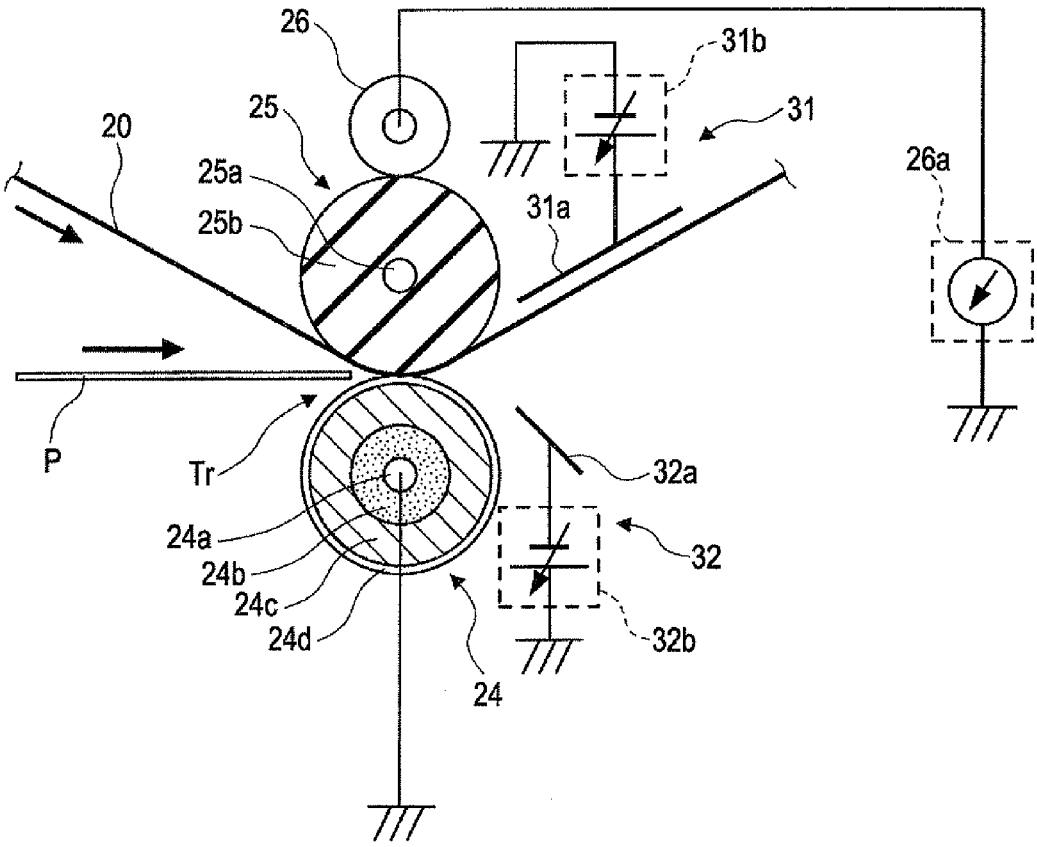
FIG. 3 illustrates in detail a second transfer system of the image forming apparatus according to the exemplary embodiment.

FIG. 3 illustrates in detail the second transfer region Tr of the image forming apparatus according to the exemplary embodiment.

In the second transfer region Tr, the second transfer roller 24, the backup roller 25, and the power feed roller 26 are disposed.

The second transfer roller 24, which corresponds to a transfer member (transfer roller) includes, sequentially from the inside, a rotation shaft 24*a*, a foam layer 24*b*, a solid layer 24*c*, and a coating layer 24*d*. The rotation shaft 24*a* is a metal shaft made of, for example, stainless steel. The foam layer 24*b* is made of a foam of, for example, polyepichlorohydrin rubber or polyurethane rubber. The solid layer 24*c* is made of polyepichlorohydrin rubber or polyurethane rubber. The coating layer 24*d* is made of fluorocarbon rubber or the like. The second transfer roller 24 has a volume resistivity in the range of, for example, $10^3$ Ω·cm to $10^{10}$ Ω·cm.

The backup roller 25 includes, sequentially from the inside, a rotation shaft 25*a* and an elastic layer 25*b*. The rotation shaft 25*a* is made of stainless steel or the like. The elastic layer 25*b*, which is single-layered or multilayered, is made of EPDM or a rubber material, such as polyepichlorohydrin rubber. The backup roller 25 has a volume resistivity in the range of, for example, $10^3$ Ω·cm to $10^{10}$ Ω·cm.

The power feed roller 26 is made of a metal, such as aluminum.

The power feed roller 26 is connected to a current source 26*a*. Under a predetermined control, the current source 26*a* supplies a second transfer bias (second transfer current), which is a negative bias, to the backup roller 25 through the power feed roller 26. The second transfer bias generates a transfer electric field between the second transfer roller 24 and the backup roller 25, whereby the toner images are transferred from the intermediate transfer belt 20 to a sheet P.

A first eliminating unit 31 is disposed in the second transfer region Tr. The first eliminating unit 31 suppresses sticking of the sheet P after the second transfer from sticking to the intermediate transfer belt 20 and suppresses scattering of the toner, which has been second transferred to the sheet P, due to electrostatic discharge. The first eliminating unit 31 includes a first eliminating plate 31*a* and a first eliminating power source 31*b*. The first eliminating plate 31*a* is a conductive member that is disposed inside the loop of the intermediate transfer belt 20 that has passes through the second transfer region Tr. The first eliminating power source 31*b* supplies an eliminating bias to the first eliminating plate 31*a*. The first eliminating plate 31*a* is made of, for example, an electrogalvanized steel plate having a thickness of, for example, 0.8 mm. The first eliminating plate 31*a* is disposed parallel to the intermediate transfer belt 20 with a predetermined distance (for example, 5 mm) therebetween. The first eliminating power source 31*b*, which applies a positive eliminating bias to the first eliminating plate 31*a*, is capable of changing the strength of the bias.

Moreover, a second eliminating unit 32 is disposed in the second transfer region Tr. The second eliminating unit 32 suppresses sticking of the sheet P after the second transfer from sticking to the second transfer roller 24 and suppresses scattering of the toner, which has been second transferred to the sheet P, due to electrostatic discharge. The second eliminating unit 32 includes a second eliminating plate 32*a* and a second eliminating power source 32*b*. The second eliminating plate 32*a* is a conductive member that is disposed adjacent to a portion of the second transfer roller 24 that has passed through the second transfer region Tr. The second eliminating power source 32*b* supplies an eliminating bias to the second eliminating plate 32*a*. The second eliminating plate 32*a* is made of, for example, a stainless steel plate having a thickness of, for example, 0.5 mm. The second eliminating plate 32*a* includes multiple of pointed protrusions (not shown) for concentrating an operative electric field on a side that faces the sheet P. The second eliminating power source 32*b* applies a negative eliminating bias to the second eliminating plate 32*a*, and is capable of changing the strength of the bias.

While the image formation is repeated, the graininess of red color, green color, and black color may decrease in the image. In this case, the image looks rough. This phenomenon occurs because, for one reason, adhesion toner of Y color and the toner of K color varies with time. That is, in the first transfer system described above, adhesion of the toner in Y color and K color increases with time, and the toner images more strongly adhere to the intermediate transfer belt 20 when the toner images are transferred from the photoconductor drums 12. As a result, the toner images are not smoothly transferred from the intermediate transfer belt 20 to the sheet P in the second transfer region Tr, a part of the toner is not transferred, and the toner is easily scattered. When the toner scatters, a toner image formed of the scattered toner is transferred to a position of the sheet P to which an image should not to be transferred. When the toner image of the scattered toner is fixed by the fixing unit 60, the toner image is recognized as an image having a low graininess.

This phenomenon frequently occurs for the toner in Y color and the toner in K color and does not usually occur for the toner in M color and the toner in C color. Therefore, the graininess of red color, green color, and black color, which use toner of at least one of Y color and K color, decreases. This phenomenon occurs not because of the color of the toner that provides a specific characteristic to the toner, but because of the positions of the image forming units 11 containing the toner that are located at both end portions. This is due to the difference in the tension applied to the intermediate transfer belt 20 at positions corresponding to the respective first transfer rollers 21. That is, the intermediate transfer belt 20 is looped over the driving roller 22, the span roller 23, and the second transfer roller 24. At the positions corresponding to the first transfer rollers 21Y and 21K for the Y color and K color that are at end portions, a high tension is applied to the intermediate transfer belt 20 due to the influence of the span roller 23 and the driving roller 22. In contrast, at the positions corresponding to the first transfer rollers 21M and 21C for the M color and C color that are in the intermediate portion, a relatively low tension is applied to the intermediate transfer belt 20. As a result, the effective load with which the intermediate transfer belt 20 is pressed against the photoconductor drums 12 of the image forming units 11 is larger at the positions corresponding to M color and C color than at the positions corresponding to Y color and K color. Thus, toner of Y color and K color strongly adheres to the intermediate transfer belt 20. This phenomenon occurs more frequently when image formation is repeatedly performed and the toner becomes old. In particular, the difference in the tension is large when the axis of the first transfer roller 21 is not disposed directly below the axis of the photoconductor drum 12 and the axes are disposed so as to be offset from each other as illustrated in FIG. 2.

In the exemplary embodiment, the pressing forces with which the first transfer rollers 21 disposed at end portions press the intermediate transfer belt 20 are set to be smaller than the pressing forces with which the first transfer rollers 21 disposed in the intermediate portion press the intermediate transfer belt 20. That is, the pressing forces applied by the first transfer rollers 21Y and 21K to the intermediate transfer belt 20 are set to be smaller than the pressing forces applied by the first transfer rollers 21M and 21C to the intermediate transfer belt 20. This cancels out the difference in the pressing force applied to the photoconductor drums 12 by the tension of the intermediate transfer belt 20. As a result, effective load acting on the toner at first transfer nip portions, at which the intermediate transfer belt 20 presses the photoconductor drums 12, is made uniform using a simple technique, so that adhesion with which the toner adheres to the intermediate transfer belt 20 is made uniform. To be specific, the following techniques may be used.

Figure 4:
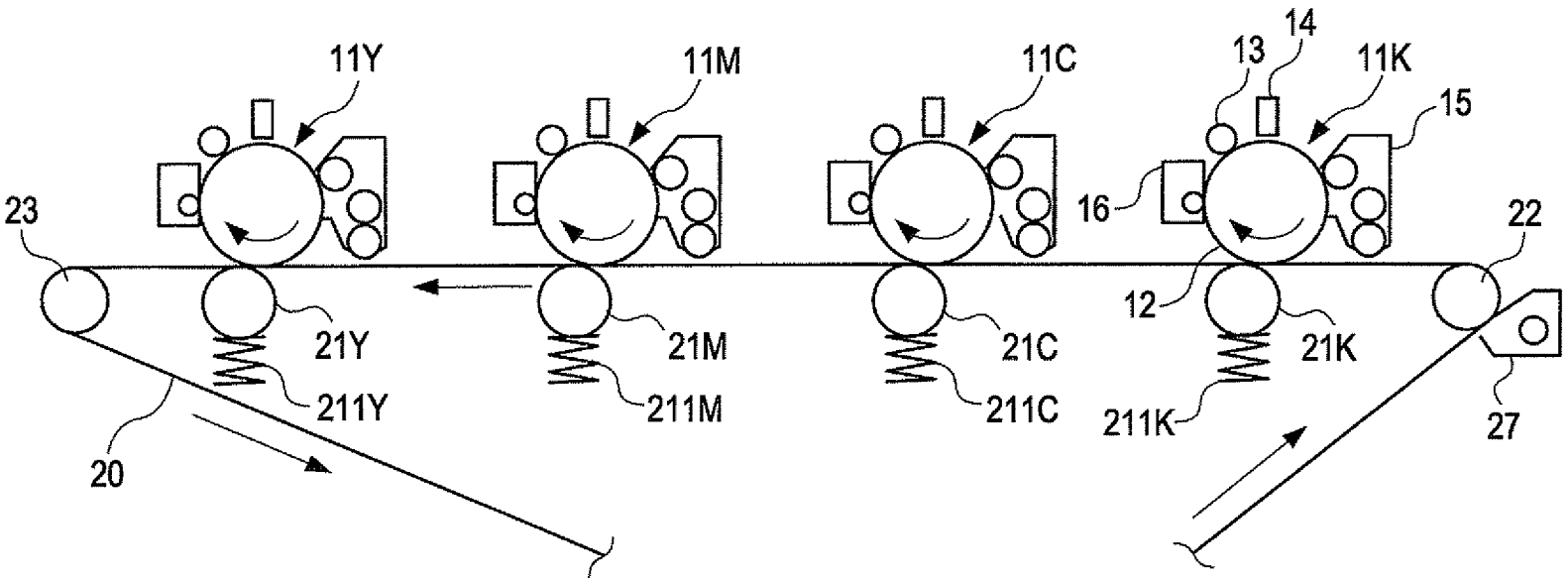
FIG. 4 schematically illustrates a first example of the first transfer system according to the exemplary embodiment.

FIG. 4 schematically illustrates a first example of the first transfer system according to the exemplary embodiment.

In the first transfer system illustrated in FIG. 4, the first transfer rollers 21 are pressed against the intermediate transfer belt 20 by using elastic members 211Y, 211M, 211C, and 211K (hereinafter collectively referred to as "elastic members 211"), which are respectively attached to the first transfer rollers 21Y, 21M, 21C, and 21K. The elastic members 211 are, for example, spring members. The pressing forces applied by the first transfer rollers 21 to the intermediate transfer belt 20 are set by adjusting the loads generated by the elastic members 211.

To be specific, the loads generated by the elastic members 211Y and 211K are higher than the loads generated by the elastic members 211M and 211C. Thus, the pressing forces applied by the first transfer rollers 21Y and 21K to the intermediate transfer belt 20 are made smaller than the pressing force applied by the first transfer rollers 21M and 21C to the intermediate transfer belt 20. For example, the loads generated by elastic member 211Y and 211K are 10 gf/cm, and the loads generated by the elastic members 211M and 211C are 14.5 gf/cm.

Figure 5:
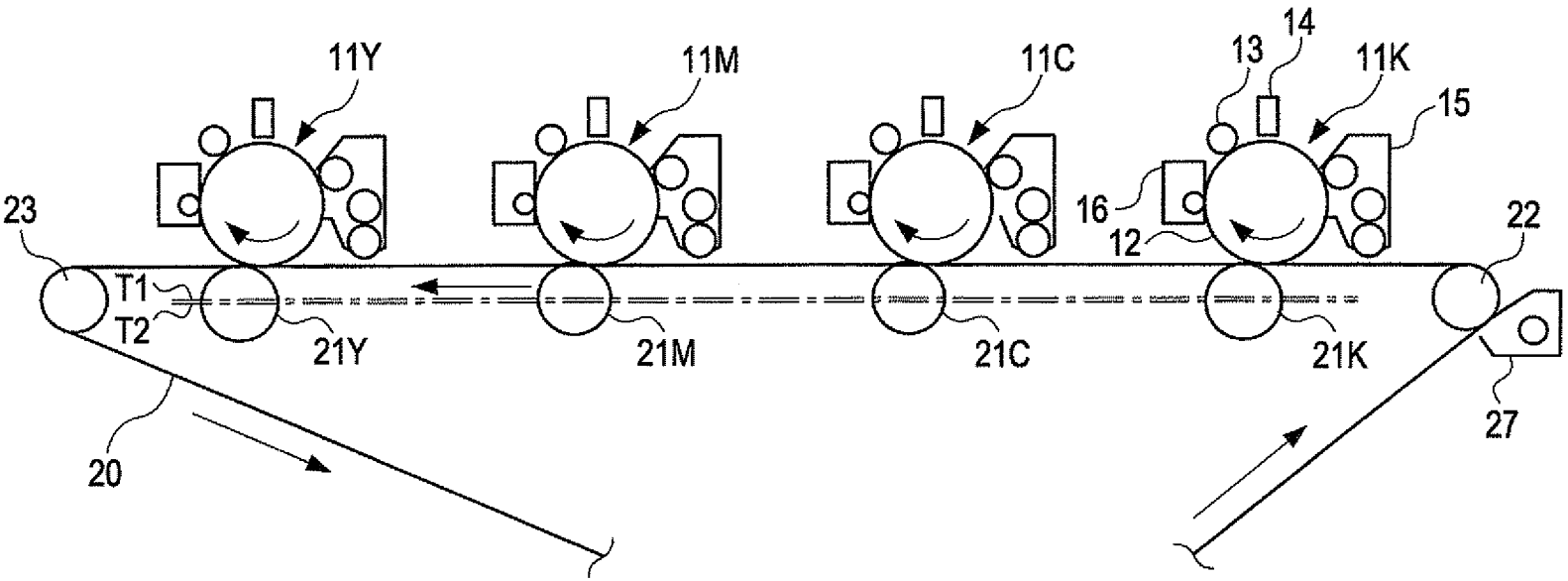
FIG. 5 schematically illustrates a second example of the first transfer system according to the exemplary embodiment.

FIG. 5 schematically illustrates a second example of the first transfer system according to the exemplary embodiment.

In the first transfer system illustrated in FIG. 5, the pressing forces applied by the first transfer rollers 21 to the intermediate transfer belt 20 are set by adjusting the positions of the axes of the first transfer rollers 21.

That is, the distance between the intermediate transfer belt 20 and the axes of first transfer rollers 21Y and 21K is made larger than the distance between the axes of the intermediate transfer belt 20 and the first transfer rollers 21M and 21C. The difference between the distances is, for example, 1.5 mm. Thus, the pressing forces applied by the first transfer rollers 21Y and 21K to the intermediate transfer belt 20 are made smaller than the pressing force applied by the first transfer rollers 21M and 21C to the intermediate transfer belt 20. In FIG. 5, a center line T1 represents a line connecting the axes of the first transfer rollers 21M and 21C, and a center line T2 represents a line connecting the axes of the first transfer rollers 21Y and 21K.

Figure 6:
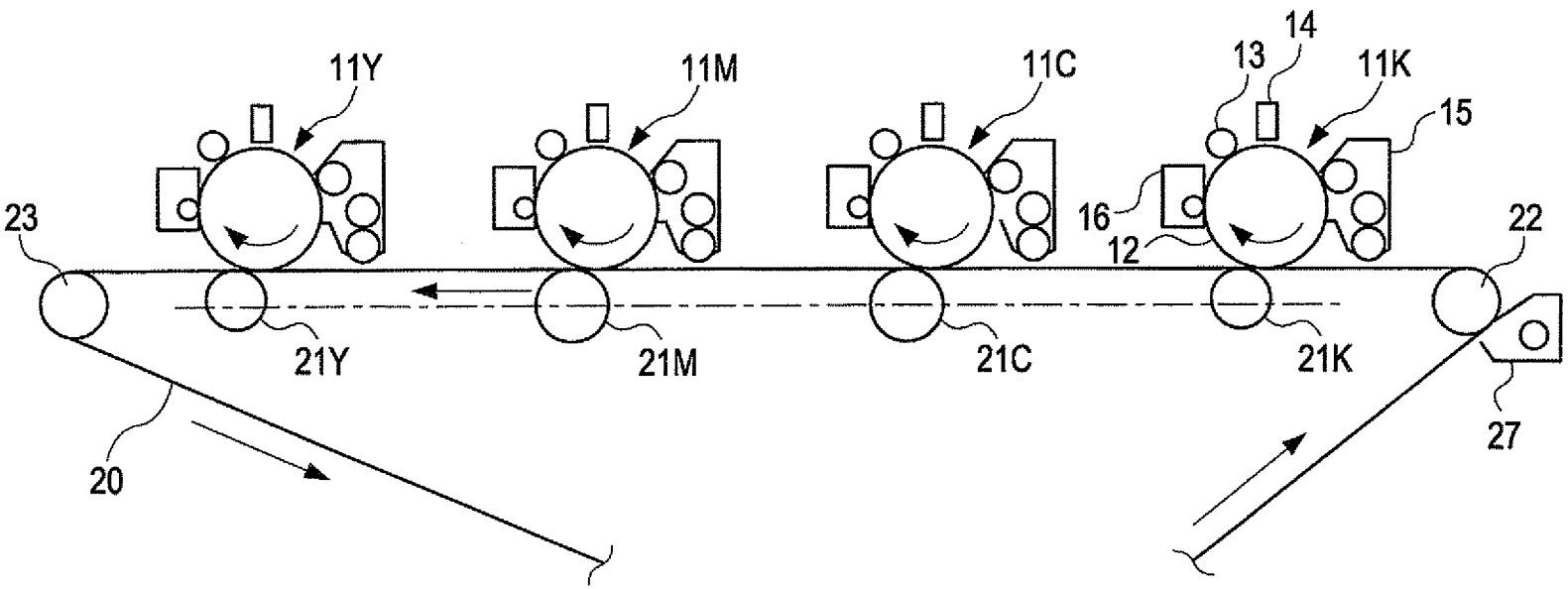
FIG. 6 schematically illustrates a third example of the first transfer system according to the exemplary embodiment.

FIG. 6 schematically illustrates a third example of the first transfer system according to the exemplary embodiment.

In the first transfer system illustrated in FIG. 6, the pressing forces applied by the first transfer rollers 21 to the intermediate transfer belt 20 are set by adjusting the diameters of the first transfer rollers 21.

That is, the diameters of the first transfer rollers 21Y and 21K are made smaller than the diameters of the first transfer rollers 21M and 21C. Thus, the pressing forces applied by the first transfer rollers 21Y and 21K to the intermediate transfer belt 20 are made smaller than the pressing force applied by the first transfer rollers 21M and 21C to the intermediate transfer belt 20.

Alternatively, as a fourth example of the first transfer system according to the exemplary embodiment, the pressing forces applied by the first transfer rollers 21 to the intermediate transfer belt 20 may be set by adjusting the hardnesses of the surfaces of the first transfer rollers 21.

That is, the hardnesses of the surfaces of the first transfer rollers 21Y and 21K are made smaller than the hardnesses of the surfaces of the first transfer rollers 21M and 21C. In other words, the surfaces of the first transfer rollers 21Y and 21K are made softer than the surfaces of the first transfer rollers 21M and 21C, or the elastic modulus is made smaller. Thus, the pressing forces applied by the first transfer rollers 21Y and 21K to the intermediate transfer belt 20 are made smaller than the pressing force applied by the first transfer rollers 21M and 21C to the intermediate transfer belt 20.

As a further alternative, the techniques described above may be used in combination.

In the examples described above, the image forming apparatus 1 is of a so-called "tandem-type". However, the invention is not limited thereto. For example, the aforementioned techniques may be applied to any image forming apparatus including an image transfer body, such as an intermediate transfer belt, and pressing members that nip the image transfer body therebetween, such as first transfer rollers, and transfers toner images by using the image transfer body and the pressing members. That is, in an image forming apparatus having such a structure, a pressing force applied to the image transfer body by each of the pressing members is set in accordance with the tension applied by the pressing member to the image transfer body at the position at which the pressing member contacts the image transfer body. To be specific, a pressing force applied to the image transfer body by the pressing member is set so that the pressing force is relatively small at a position at which a relatively high tension is acting on the image transfer body and so that the pressing force is relatively large at a position at which a relatively low tension is acting on the image transfer body. Thus, the difference of adhesion with which the toner of different colors adheres to the image transfer body is reduced.

In the exemplary embodiment, when the photoconductor drum 12 and the first transfer roller 21 are disposed so as to be at offset positions and so as to overlap each other when viewed from above as illustrated in FIG. 2, the wrap amount over which the intermediate transfer belt 20 contacts the photoconductor drum 12 is adjusted by using the techniques described above. Therefore, the techniques described above may be stated in another way that a wound amount over which the intermediate transfer belt 20 contacts the photoconductor drum 12 is set in accordance with the tension acting on the intermediate transfer belt 20 at positions at which the first transfer roller 21Y, 21M, 21C, and 21K (first transfer rollers 21) contact the intermediate transfer belt 20. To be specific, the wound amount is set to be relatively small at a position at which a relatively high tension is acting on the intermediate transfer belt 20 and set to be relatively large at a position at which a relatively low tension is acting on the intermediate transfer belt 20.

In the above examples, the pressing members are first transfer rollers 21, which are rotational bodies. However, the pressing members are not limited thereto, and may be, for example, plate-shaped members. However, the pressing members may be rotational bodies in view of reduction of friction between the pressing members and the intermediate transfer belt 20.

EXAMPLES

Example 1

Image formation was performed using the image forming apparatus 1 illustrated in FIG. 1. The toner containers 17Y, 17M, 17C, and 17K at color positions corresponding to Y color, M color, C color, and K color were filled with toner of K color. Thus, a difference in the result due to the difference in the characteristics of the toner of different colors were eliminated. Using the technique illustrated in FIG. 5, the distance between the intermediate transfer belt 20 and the axes of the first transfer rollers 21Y and 21K was set to be larger than the distance between the intermediate transfer belt 20 and the axes of the first transfer rollers 21M and 21C. The difference in the distances was 1.5 mm. The diameter of the first transfer rollers 21 was 28 mm. As the sheet, J paper (manufactured by Fuji Xerox Co., Ltd. (A3, basis weight 82 $g/m^2$) was used. The image coverage was 3%, and image formation was performed on 10000 sheets using each of the image forming units 11Y, 11M, 11C, and 11K.

Graininess (roughness) of an image formed in the initial state and graininess of an image formed by the 10000-th image formation were visually checked and evaluated. The result was evaluated in five grades. To be specific, the grades included grade 0 (no roughness), grade 1 (substantially no roughness), grade 2 (inconspicuous roughness), grade 3 (conspicuous roughness), and grade 4 (very conspicuous roughness).

Comparative Example 1

Image formation was performed without changing the positions of the axes of the first transfer rollers 21Y and 21K, and the first transfer rollers 21Y and 21K were disposed in the same manner as the first transfer rollers 21M and 21C. The other conditions were the same as those of example 1. The result was evaluated in the same manner as example 1.

Figure 7:
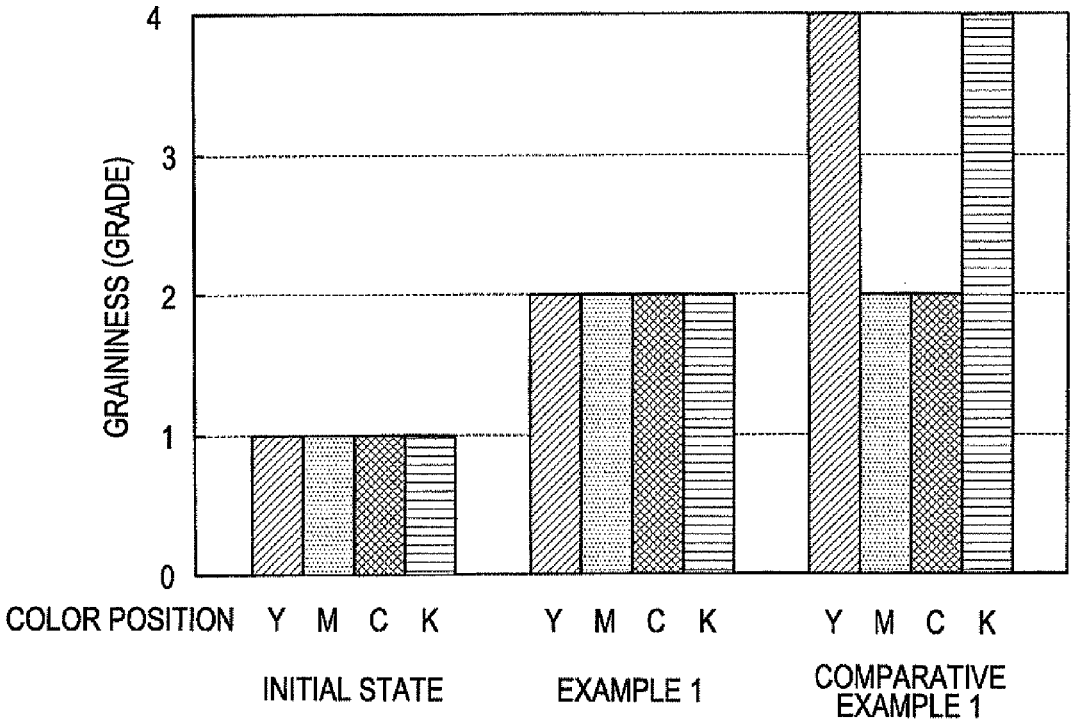
FIG. 7 illustrates an evaluation result.

FIG. 7 illustrates the result of evaluation.

As illustrated in FIG. 7, in example 1, the graininess of formed images increased by only one grade from grade 1 in the initial state to grade 2 after 10000 image formation, and difference between the color positions did not occur.

In contrast, in comparative example 1, the graininess of formed images increased by only one grade from grade 1 in the initial state to grade 2 after 10000 image formation for the color positions for M color and C color, but the graininess of formed images increased by three grades (deteriorated) from grade 1 in the initial state to grade 4 after 10000 image formation for the color positions for Y color and K color.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of toner image forming units that are arranged in a line at two end portions of the line and at an intermediate portion of the line, each of the plurality of toner image forming units forming a toner image;

an image transfer body to which the toner images formed by the plurality of toner image forming units are transferred;

a plurality of pressing members that are linearly arranged so that each of the plurality of pressing members faces a corresponding one of the toner image forming units with the image transfer body therebetween, each of the plurality of pressing members applying a pressing force to the image transfer body; and a fixing unit that fixes the toner images on a recording member, wherein the pressing forces applied by the pressing members that are disposed at the two end portions of the line are smaller than the pressing force applied by the pressing member that is disposed in the intermediate portion of the line.

2. The image forming apparatus according to claim 1, wherein the pressing forces applied by the pressing members to the image transfer body are set by adjusting loads generated by elastic members attached to the pressing members.

3. The image forming apparatus according to claim 1, wherein the pressing members are rotational bodies, and the pressing forces applied by the pressing members to the image transfer body are set by adjusting positions of axes of the pressing members.

4. The image forming apparatus according to claim 1, wherein the pressing members are rotational bodies, and the pressing forces applied by the pressing members to the image transfer body are set by adjusting diameters of the pressing members.

5. The image forming apparatus according to claim 1, wherein the pressing forces applied by the pressing members to the image transfer body are set by adjusting a surface hardness of the pressing members.

6. An image forming apparatus comprising:

a plurality of toner image forming units each forming a toner image;

an image transfer body to which the toner images formed by the plurality of toner image forming units are transferred;

a plurality of pressing members that are arranged so that each of the plurality of pressing members faces a corresponding one of the toner image forming units with the image transfer body therebetween, each of the plurality of pressing members applying a pressing force to the image transfer body; and a fixing unit that fixes the toner images on a recording member, wherein a first line connecting an axis of first pressing members disposed at two end portions deviates from a second line connecting an axis of second pressing members disposed between the first pressing members, and pressing forces applied by the first pressing members that are disposed at each of the two end portions are different than a pressing force applied by a pressing member disposed between the first pressing members that are disposed at the two end portions.

7. An image forming apparatus comprising:

a plurality of toner image forming units each forming a toner image;

an image transfer body to which the toner images formed by the plurality of toner image forming units are transferred;

a plurality of pressing members that are arranged so that each of the plurality of pressing members faces a corresponding one of the toner image forming units with the image transfer body therebetween, each of the plurality of pressing members applying a pressing force to the image transfer body; and a fixing unit that fixes the toner images on a recording member, wherein a first line connecting an axis of first pressing members disposed at two end portions deviates from a second line connecting an axis of second pressing members disposed between the first pressing members, and wherein the first line is farther than the second line from the plurality of image forming units.

* * * * *